US009335060B2

(12) United States Patent
Kim

(10) Patent No.: US 9,335,060 B2
(45) Date of Patent: May 10, 2016

(54) INDOOR UNIT OF AIR CONDITIONER

(75) Inventor: Hankook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 304 days.

(21) Appl. No.: 13/407,851

(22) Filed: Feb. 29, 2012

(65) Prior Publication Data

US 2013/0098094 A1 Apr. 25, 2013

(30) Foreign Application Priority Data

Oct. 20, 2011 (KR) ..... 10-2011-0107554

(51) Int. Cl.

| | |
|---|---|
| ***F25D 21/14*** | (2006.01) |
| ***F24F 1/00*** | (2011.01) |
| ***F24F 13/20*** | (2006.01) |

(52) U.S. Cl.

CPC ..... *F24F 1/0011* (2013.01); *F24F 13/20* (2013.01); *F24F 2001/0048* (2013.01)

(58) Field of Classification Search

CPC ..... F24F 1/0011; F24F 13/32; F24F 13/30; F24F 2001/0048; F24F 13/28; F24F 13/20; F24F 1/00

USPC ..... 62/291; 165/104.34

See application file for complete search history.

(56) References Cited

U.S. PATENT DOCUMENTS

| | | | | | |
|---|---|---|---|---|---|
| 2,822,674 | A * | 2/1958 | Simmons | 62/291 | |
| 4,385,505 | A * | 5/1983 | Umezu et al. | 62/285 | |
| 4,520,864 | A * | 6/1985 | Katagiri et al. | 165/60 | |
| 4,733,542 | A * | 3/1988 | Blair | 62/263 | |
| 5,095,716 | A | 3/1992 | You | | |
| 2005/0223585 | A1* | 10/2005 | Jeon et al. | 34/82 | |
| 2005/0279121 | A1* | 12/2005 | Ju et al. | 62/419 | |
| 2006/0032260 | A1* | 2/2006 | Kang | 62/317 | |
| 2009/0158765 | A1* | 6/2009 | Ooishi et al. | 62/263 | |
| 2010/0107671 | A1* | 5/2010 | Okada | F24F 1/0007 62/259.1 | |
| 2011/0232861 | A1* | 9/2011 | Stewart et al. | 165/59 | |

FOREIGN PATENT DOCUMENTS

| | | | |
|---|---|---|---|
| CN | 2503402 | Y | 7/2002 |
| CN | 1755203 | A | 4/2006 |
| CN | 1979050 | A | 6/2007 |
| JP | 2001132973 | A * | 5/2001 |
| KR | 1020020027866 | A | 4/2002 |
| KR | 1020030067231 | A | 8/2003 |

* cited by examiner

*Primary Examiner* — Marc Norman
*Assistant Examiner* — Ana Vazquez
(74) *Attorney, Agent, or Firm* — Dentons US LLP

(57) ABSTRACT

An indoor unit of an air conditioner includes an intake port, a heat exchanger, a fan, and a discharge port. The intake port introduces air. The heat exchanger exchanges heat with the introduced air. The fan is disposed above the heat exchanger. The discharge port discharges the air after exchanging heat with the heat exchanger. The intake port is lower than a center of the fan. The discharge port is higher than the center of the fan.

17 Claims, 10 Drawing Sheets

INDOOR UNIT OF AIR CONDITIONER

CROSS-REFERENCE TO RELATED APPLICATIONS

The present application claims priority under 35 U.S.C. 119 and 35 U.S.C. 365 to Korean Patent Application No. 10-2011-0107554, filed Oct. 20, 2011, which is hereby incorporated by reference in its entirety.

BACKGROUND

The present disclosure relates to an indoor unit of an air conditioner.

Air conditioners perform a refrigerant cycle by means of a compressor, a condenser, an expansion device, and an evaporator to heat/cool an indoor space or purify air, thereby providing comforting indoor environment to users.

Air conditioners are classified into air conditioners in which a single indoor unit is connected to a single outdoor unit, and multi-type air conditioners in which air conditioners are connected to one or more outdoor units to provide the effect of a plurality of air conditioners.

An indoor unit of an air conditioner comprises a chassis and a frame coupled to the front of the chassis. The chassis supports a heat exchanger, and guides air flow. The frame is provided with an intake port and a discharge port.

The intake port is disposed at the upper side of the indoor unit, and the discharge port is disposed at the lower side thereof. When the intake port is disposed at the upper side of the indoor unit, dust formed on the intake port can be hidden from a user. Also, when the indoor unit is in cooling operation, the rising indoor warm air (higher in temperature than cooled air) is forcibly moved downward within the indoor unit opposing a natural air flow, and a flow rate of the air within the indoor unit may be decreased. Also, since cool air of low temperature is discharged from the lower side of the indoor unit, the cool air is discharged towards the floor, and thus, an indoor space may be unevenly cooled.

SUMMARY

Embodiments provide an indoor unit of an air conditioner.

In one embodiment, an indoor unit of an air conditioner comprises: an intake port to introduce air; a heat exchanger to exchange heat with the air introduced by the intake port; a fan disposed above the heat exchanger; and a discharge port to discharge the air after exchanging heat with the heat exchanger, wherein the intake port is lower than a center of the fan, and the discharge port is higher than the center of the fan.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

An indoor unit of a wall-mounted type air conditioner will now be described. The indoor unit of a wall-mounted type air conditioner may be installed on a side wall in an indoor space, and be spaced apart from a floor and a ceiling in the indoor space.

Figure 1:
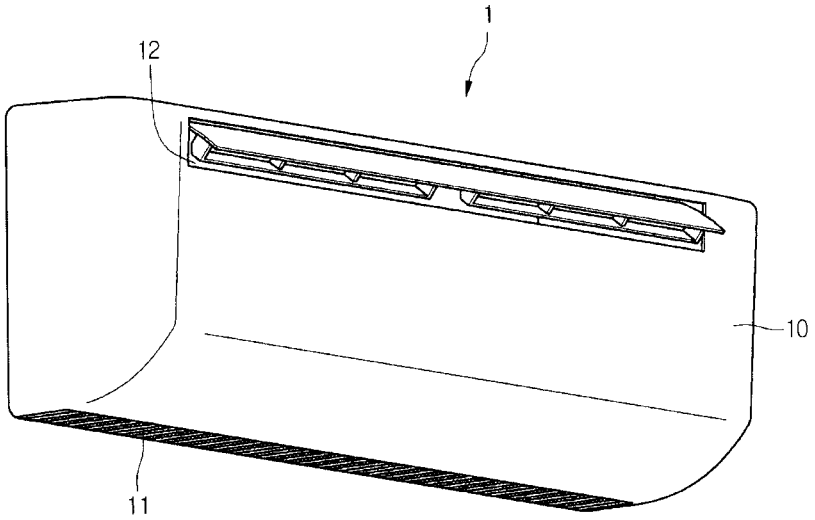
FIG. 1 is a perspective view illustrating the front side of an indoor unit of an air conditioner according to a first embodiment.
Figure 2:
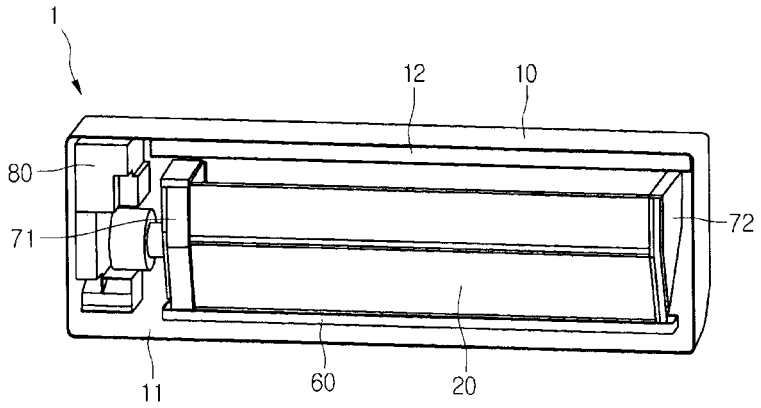
FIG. 2 is a perspective view illustrating the rear side of the indoor unit according to the first embodiment.
Figure 3:
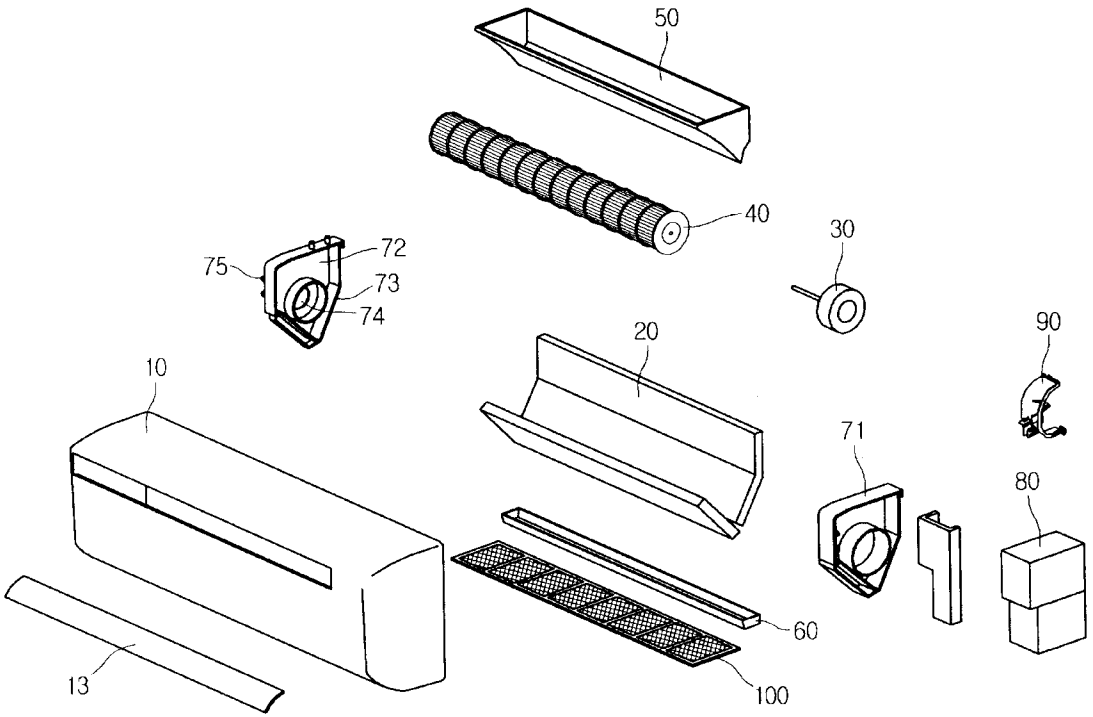
FIG. 3 is an exploded perspective view illustrating the indoor unit according to the first embodiment.

FIG. 1 is a perspective view illustrating the front side of an indoor unit of an air conditioner according to a first embodiment. FIG. 2 is a perspective view illustrating the rear side of the indoor unit according to the first embodiment. FIG. 3 is an exploded perspective view illustrating the indoor unit according to the first embodiment.

Referring to FIGS. 1 to 3, an indoor unit 1 of an air conditioner according to the first embodiment may comprise: a frame 10 forming the appearance thereof; a heat exchanger 20 accommodated in the frame 10 and exchanging heat with introduced indoor air; a fan 40 moving the indoor air; a motor 30 rotating the fan 40; a flow guide 50 guiding air flow within the frame 10; a drain pan 60 collecting condensate water falling from the heat exchanger 20; and a control box 80 controlling the indoor unit 1.

In detail, the frame 10 may form the front, both side, top, and bottom surfaces of the indoor unit 1. That is, the frame 10 has a rear opening. Although not shown, the rear opening may be covered with an installation panel for installing the indoor unit 1 on a wall.

The bottom surface of the frame 10 is provided with an intake port 11 for introducing indoor air, and, according to the first embodiment, the front surface of the frame 10 is provided with a discharge port 12 for discharging the air after exchanging heat with the heat exchanger 20. Alternatively, the discharge port 12 is provided on the top surface of the frame 10. The intake port 11 is lower than the discharge port 12.

The discharge port 12 may be disposed on the front upper portion of the frame 10, or be disposed on the top surface of the frame 10, or on the top and front surfaces of the frame 10.

The discharge port 12 of the frame 10 is provided with a vane 13. The vane 13 may control the direction of discharged air.

The frame 10 is provided with a filter 100 for filtering air introduced in the frame 10. The filter 100 is disposed at a downstream of the intake port 11. Thus, the filter 100 can filter air passing through the intake port 11. The filter 100 may be taken out through the rear opening of the frame 10. Alternatively, the lower surface of the frame 10 may be provided with a hole and a cover, so that the filter 100 can be inserted in and taken out from the frame 10 through the hole.

The heat exchanger 20 may be bent at least one time to increase a heat exchange area, but is not limited thereto. Both sides of the heat exchanger 20 are coupled to supporters 71 and 72. The heat exchanger 20 is supported by the supporters 71 and 72. The supporters 71 and 72 comprise a first supporter (also denoted by 71) supporting a side portion of the heat exchanger 20, and a second supporter (also denoted by 72) supporting another side portion of the heat exchanger 20. Thus, the supporters 71 and 72 comprise heat exchanger seating parts 73, respectively, which have a shape to correspond with a side portion of the heat exchanger 20.

For example, the fan 40 may be a cross flow fan. The fan 40 may pass through the supporters 71 and 72. Thus, the supporters 71 and 72 may be provided with holes 74, so that the fan 40 can pass therethrough. Alternatively, the first supporter 71 may be provided with a hole to allow the fan 40 through, and the second supporter 72 may be provided with a seating part to seat the fan 40.

At least one of the first and second supporters 71 and 72 may be provided with a coupled part 75 for coupling to the frame 10.

A shaft of the motor 30 is connected to a side portion of the fan 40. The shaft of the motor 30 may pass through the hole of the first supporter 71. The motor 30 may be placed on the control box 80. Then, the motor 30 may be covered with a motor cover 90.

Hereinafter, an inner structure of the indoor unit will now be described.

Figure 4:
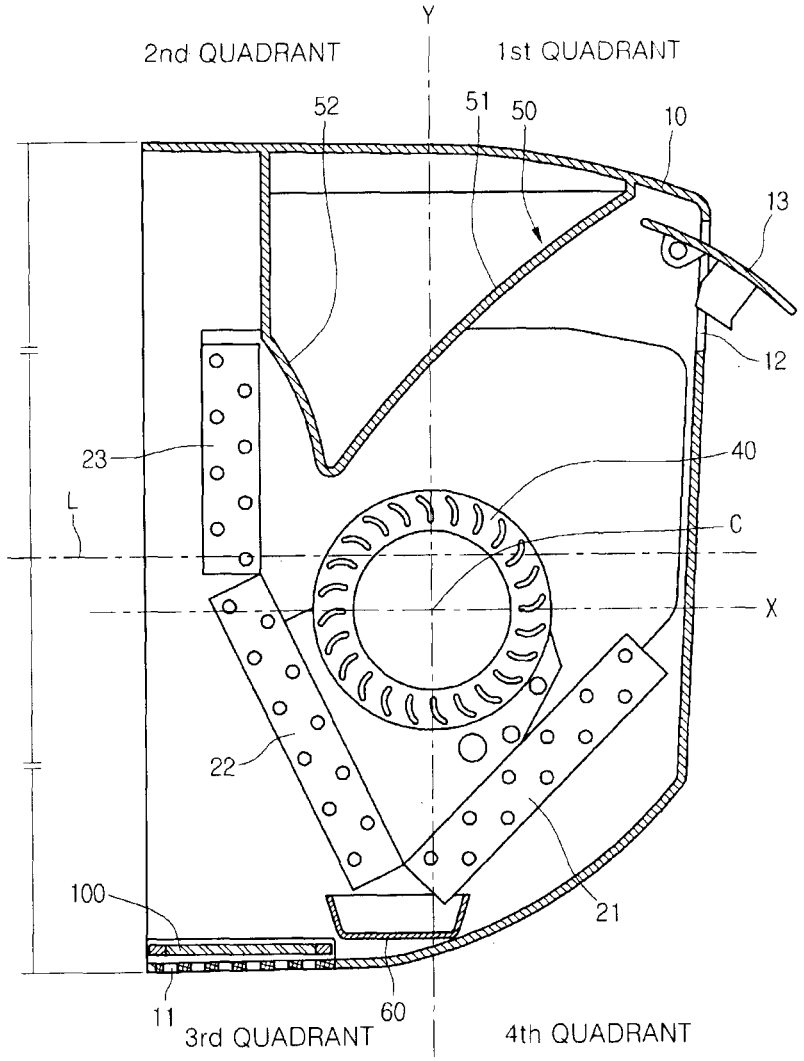
FIG. 4 is a cross-sectional view illustrating the indoor unit according to the first embodiment.

FIG. 4 is a cross-sectional view illustrating the indoor unit according to the first embodiment.

The right and left sides of FIG. 4 correspond to the front and rear sides of the indoor unit 1, respectively.

Referring to FIGS. 3 and 4, the heat exchanger 20 is disposed at the downstream of the intake port 11, and the fan 40 is disposed at a downstream of the heat exchanger 20. That is, when the fan 40 rotates, indoor air is introduced into the frame through the intake port 11, then, passes through the heat exchanger 20, and then, flows to the fan 40.

Referring to FIG. 4, the indoor unit 1 may be divided into four regions by an X-axis and a Y-axis about a center C of the fan 40.

Among the four regions of the indoor unit 1, the region disposed at the front upper side of the indoor unit 1 may be defined as a first quadrant, and the numbering may go counter-clockwise starting from the first quadrant. That is, the second quadrant is disposed at the rear upper side of the indoor unit 1, the third quadrant is disposed at the rear lower side of the indoor unit 1, and the fourth quadrant is disposed at the front lower side of the indoor unit 1. Since the four regions are separated with respect to the center C of the fan 40, the area of the four regions may be varied by shifting the fan 40. The center C of the fan 40 is lower than a line L bisecting a height of the frame 10 (i.e., the indoor unit 1).

When the indoor unit 1 is divided into the four quadrants, at least one portion of the intake port 11 may be disposed in the third quadrant, and the discharge port 12 may be disposed in the first quadrant. Although the intake port 11 is disposed only in the third quadrant in FIG. 4, the intake port 11 may be disposed in both the third and fourth quadrants. In this case, air introduced through the intake port 11 rises in the indoor unit 1, and flows to the front side of the indoor unit 1. In addition, the center C of the fan 40 is closer to the front surface of the indoor unit 1 (the front surface of the frame 10) than to the intake port 11.

According to the current embodiment, the intake port 11 is lower than the center C of the fan 40, and the discharge port 12 is higher than the center C of the fan 40. Thus, the fan is higher than the intake port 11, and is lower than the discharge port 12.

When the indoor unit 1 is in cooling operation, indoor air is higher in temperature than heat-exchanged air (hereinafter, referred to as cool air) in the indoor unit 1. The high temperature air tends to move upward, and the low temperature air tends to move downward.

When an intake port 11 and a discharge port 12 are disposed as described above, air of higher temperature is introduced from the lower side of an indoor unit, then, rises and undergoes heat exchange within the indoor unit, and then, is discharged forward from the upper portion of the indoor unit. Thus, the air can naturally flow within the indoor unit, thereby increasing a flow rate of the air within the indoor unit. That is, air flow within the indoor unit can be facilitated by using a movement of high temperature air.

In addition, since cool air discharged from the upper portion of the indoor unit flows further away from the floor than cool air discharged from the lower portion of the indoor unit, an indoor space can be uniformly cooled.

The heat exchanger 20 may comprise a first part 21, a second part 22, and a third part 23. The first to third parts 21 to 23 constituting the heat exchanger 20 may be separated according to the shape of the heat exchanger 20. Alternatively, the heat exchanger 20 may comprise separate first, second, and third heat exchangers.

The first part 21 may form a predetermined angle with the second part 22, and the second part 22 may form a predetermined angle with the third part 23. At least one portion of the first part 21 may be disposed in the fourth quadrant. At least one portion of the second part 22 may be disposed in the third quadrant. At least one portion of the third part 23 may be disposed in the second quadrant.

When the shape of the heat exchanger 20 is changed, at least one of the first and third parts 21 and 23 may be removed.

Although the heat exchanger 20 may have any shape such as a straight line shape without bending, at least one portion of the heat exchanger 20 may be disposed in the third quadrant.

A connecting portion between the first and second parts 21 and 22, that is, a bent portion of the heat exchanger 20 (or one of bent portions) is the lowest portion of the heat exchanger 20. That is, a distance between the first and second parts 21 and 22 decreases downward.

The lowest portion of the heat exchanger 20 is lower than the center C of the fan 40, and is higher than the intake port 11. The center C of the fan 40 is closer to the front surface of the indoor unit 1 (the front surface of the frame 10) than to the lowest portion of the heat exchanger 20. The lowest portion of the heat exchanger 20 may be disposed in the third quadrant.

The drain pan 60 is disposed in a position corresponding to the lowest portion of the heat exchanger 20. The lowest portion of the heat exchanger 20 may be in contact with the drain pan 60, or be spaced apart therefrom.

The drain pan 60 may vertically overlap the center C of the fan 40.

Although the heat exchanger 20 is divided into a plurality of parts, the bent portion of the heat exchanger 20 is the lowest portion. Thus, the drain pan 60 as a single drain pan can collect condensate water, thereby simplifying the structure of the indoor unit 1.

When the heat exchanger 20 has a straight line shape, the heat exchanger 20 may be inclined within the indoor unit 1, and the drain pan 60 may be disposed at the lowest portion of the heat exchanger 20.

The drain pan 60 may be coupled to the bottom or a side portion of the frame 10, or be coupled to at least one of the first and second supporters 71 and 72 by a part such as a hook or screw. The drain pan 60 may be higher than the intake port 11.

The flow guide 50 is higher than the center C of the fan 40. That is, a lower portion of the flow guide 50 is higher than the center C of the fan 40.

Air, cooled through the heat exchanger 20, is guided to the discharge port 12 by the flow guide 50.

The flow guide 50 may be fixed to at least one of the first and second supporters 71 and 72, or be coupled to the top or a side portion of the frame 10 by a part such as a hook or screw. Alternatively, the flow guide 50 may be integrally formed with the frame 10.

As such, the structure of the indoor unit 1 can be simplified by separately forming the flow guide 50 or integrally forming the flow guide 50 with the frame 10.

The flow guide 50 comprises: a guiding surface 51 for guiding cool air; and a blocking surface 52 extending at a predetermined angle from the guiding surface 51, and blocking warm air toward the guiding surface 51. A distance between the guiding surface 51 and the blocking surface 52 decreases downward.

Even when indoor air is introduced through the rear opening of the frame 10, the blocking surface 52 blocks the indoor air from contacting the guiding surface 51, thereby preventing condensate water from being formed on the guiding surface 51.

Figure 5:
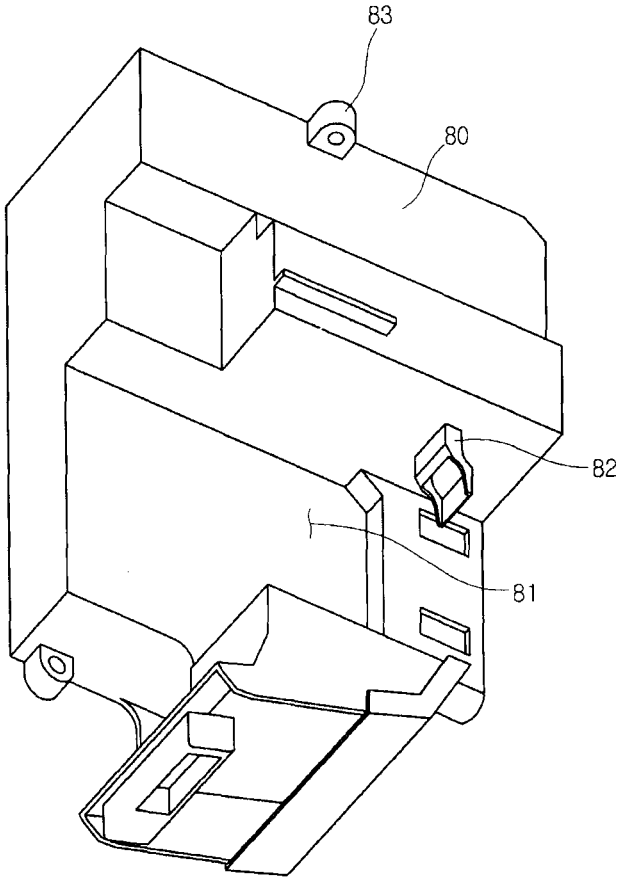
FIG. 5 is a perspective view illustrating a control box according to the first embodiment.
Figure 6:
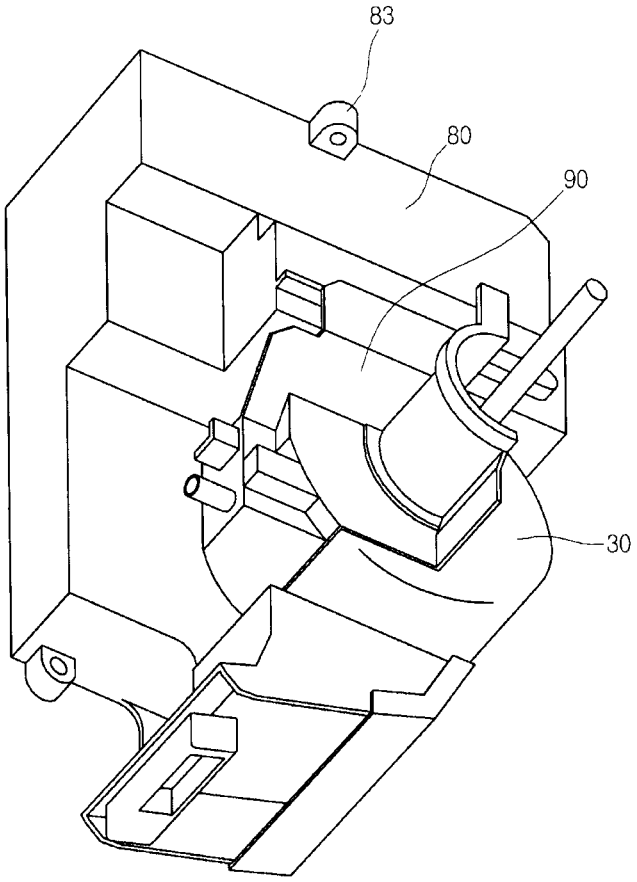
FIG. 6 is a perspective view illustrating a motor placed on the control box of FIG. 5.

FIG. 5 is a perspective view illustrating a control box according to the first embodiment. FIG. 6 is a perspective view illustrating a motor placed on the control box of FIG. 5.

Referring to FIG. 5, the control box 80 may comprise various electric or electronic parts for controlling the indoor unit 1.

The control box 80 comprises a motor accommodation part 81 for accommodating at least one portion of the motor 30. The motor accommodation part 81 is provided with at least one motor seating part 82 to seat the motor 30. The motor seating part 82 may protrude to the motor accommodation part 81, and may have at least one round portion corresponding to the motor 30.

When the motor 30 is seated on the motor seating part 82, the motor cover 90 covers the motor 30. When the motor cover 90 covers the motor 30, the motor cover 90 may be fixed to the control box 80 by a part such as a hook or a screw. The motor cover 90 may have at least one round portion corresponding to the motor 30. That is, the control box 80 and the motor cover 90 fix the motor 30 to the control box.

The motor cover 90 may partially cover the shaft of the motor 30.

The control box 80 may be provided with one or more coupling parts 83 for fixing to the frame 10.

Since the motor 30 is accommodated and fixed to the control box 80, the indoor unit 1 can be compacted, the number of parts for fixing the motor 30 can be minimized, and the structure of the indoor unit 1 can be simplified.

Figure 7:
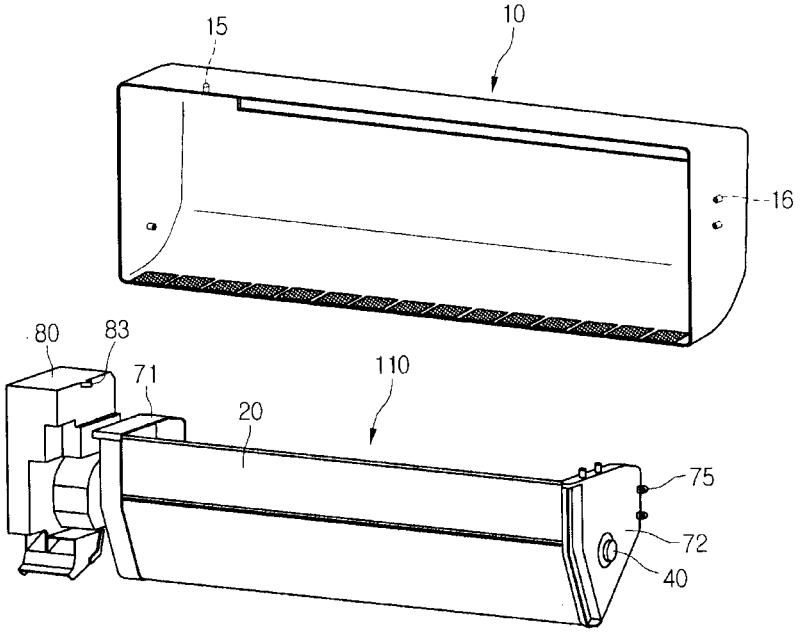
FIG. 7 is a perspective view illustrating a process of assembling the indoor unit according to the first embodiment.

FIG. 7 is a perspective view illustrating a process of assembling the indoor unit according to the first embodiment.

Referring to FIGS. 3 to 7, the motor 30 is accommodated in the motor accommodation part 81 of the control box 80 to assemble the indoor unit 1. Then, the motor 30 is seated on the motor seating part 82. Next, the motor cover 90 is coupled to the control box 80.

Then, the heat exchanger 20 and the fan 40 are coupled to the supporters 71 and 72. At this point, the fan 40 may pass through the hole 74 of the first supporter 71, or be disposed over the hole 74. Next, the shaft of the motor 30 is coupled to the fan 40.

An assembly of the control box 80, the motor 30, the motor cover 90, the heat exchanger 20, the supporters 71 and 72, and the fan 40 may be referred to as a component assembly 110.

At this point, the flow guide 50 and the drain pan 60 may constitute the component assembly 110, as described above, or be coupled to the frame 10 separately from the component assembly 110.

After being assembled, the component assembly 110 is inserted into the frame 10 through the rear opening of the frame 10. Next, the component assembly 110 is coupled to the frame 10 to complete the assembling of the indoor unit 1. That is, the control box 80 and the supporters 71 and 72 are coupled to the frame 10 to complete the assembling of the indoor unit 1. For example, the frame 10 may be provided with coupling parts 15 and 16 that are coupled to the coupling part 83 of the control box 80 and the coupled part 75 of the supporters 71 and 72 by screws. The component assembly 110 may be assembled using any method such as a hooking method and a magnetic coupling method.

Since the component assembly 110 is assembled separately outside the frame 10, and then, is coupled to the frame 10, workability and assembling efficiency thereof are improved. That is, since the number of processes of assembling parts within the frame 10 is reduced, workability thereof is improved.

Figure 8:
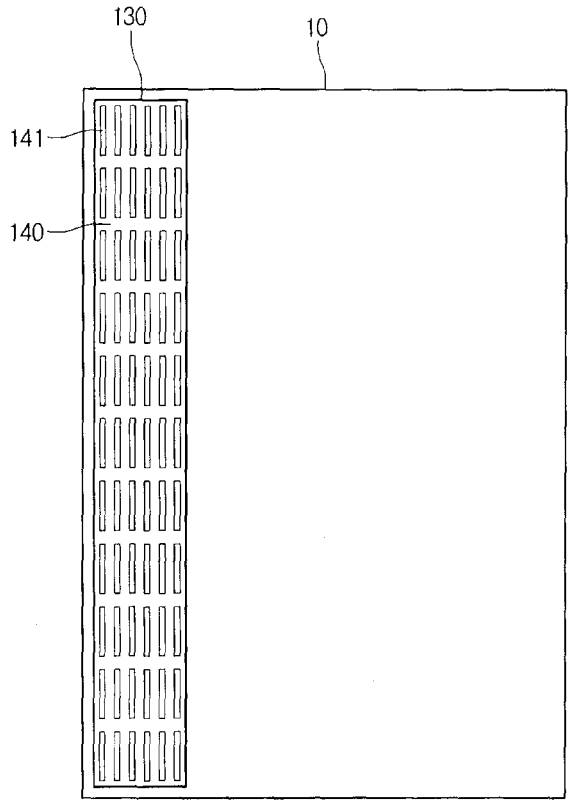
FIG. 8 is a bottom view illustrating an indoor unit of an air conditioner according to a second embodiment.
Figure 9:
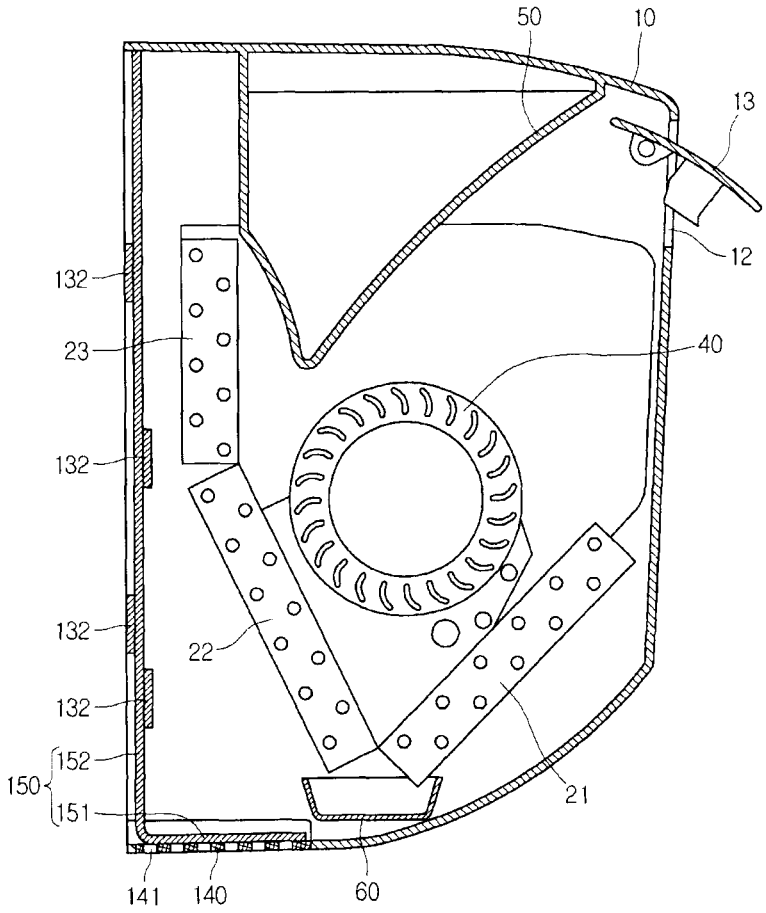
FIG. 9 is a cross-sectional view illustrating the indoor unit according to the second embodiment.
Figure 10:
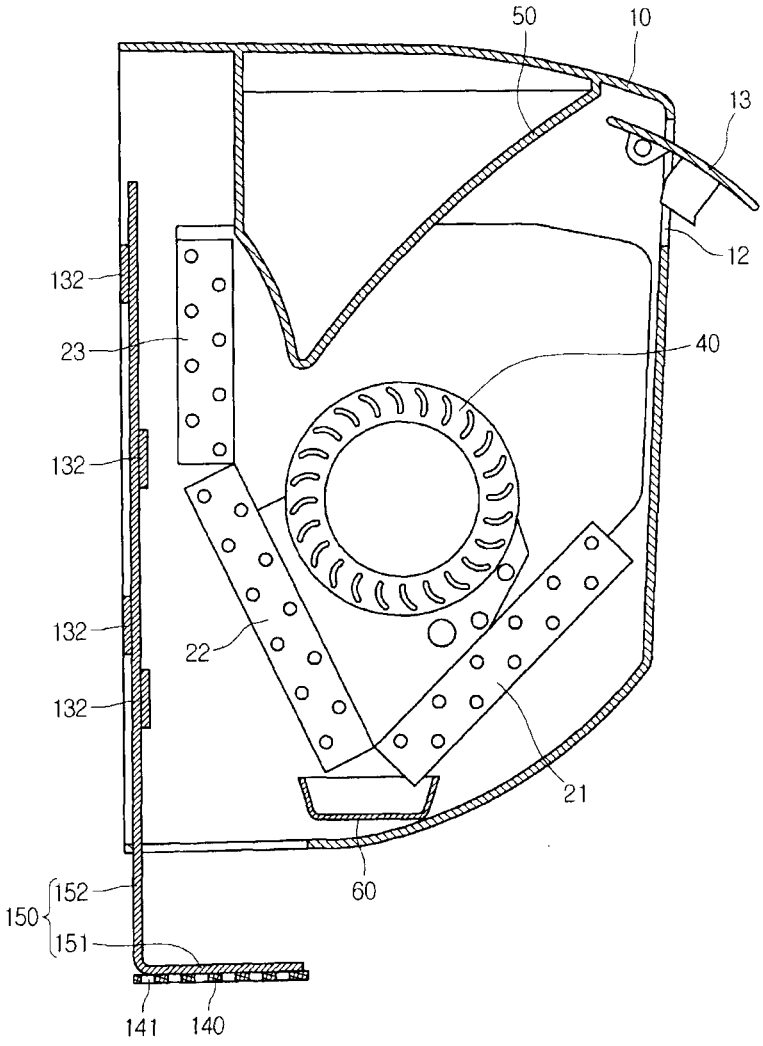
FIG. 10 is a cross-sectional view illustrating a filter removed from the indoor unit of FIG. 9.

FIG. 8 is a bottom view illustrating an indoor unit of an air conditioner according to a second embodiment. FIG. 9 is a cross-sectional view illustrating the indoor unit according to the second embodiment. FIG. 10 is a cross-sectional view illustrating a filter removed from the indoor unit of FIG. 9.

The current embodiment is the same as the first embodiment except for inserting and taking out the filter. Thus, a characterized part according to the current embodiment will be principally described.

Referring to FIGS. 8 to 10, the bottom surface of a frame 10 is provided with an opening 130 for inserting and taking out a filter. An intake grill 140 provided with intake holes 141 may be coupled to the frame 10. The intake grill 140 may be coupled to the frame 10 by a part such as a hook or a screw. The intake grill 140 covers the opening 130, and constitutes the appearance of an indoor unit 1.

The intake grill 140 supports a filter 150. The filter 150 may be integrally formed with the intake grill 140, or be coupled thereto.

The filter 150 comprises: a first filter 151 for filtering air introduced through the intake holes 141 of the intake grill 140; and a second filter 152 for filtering air introduced through a rear opening of the frame 10. That is, the second filter 152 is inclined from the first filter 151, and covers the rear opening of the frame 10. The first and second filters 151 and 152 may be integrally formed, or be separately formed.

The second filter 152 is closer to the rear portion of the indoor unit 1 than a heat exchanger 20 and a fan 40. That is, the second filter 152 is disposed between the heat exchanger 20 and the rear opening of the frame 10.

The frame 10 is provided with filter guides 132 to guide and support the second filter 152.

When the intake grill 140 is pulled down from the indoor unit 1, the intake grill 140 is removed from the indoor unit 1, and the filter 150 is taken out from the indoor unit 1.

Accordingly, the intake grill 140 and the filter 150 can be removed from the indoor unit 1 to clean the intake grill 140 and the filter 150.

Even when air is introduced through the rear portion of the indoor unit 1, the air can be filtered by the second filter 152 covering the rear opening of the frame 10.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor unit of an air conditioner, comprising:

a frame having a rear opening;

an intake port disposed at a lower surface of the frame to introduce air;

a heat exchanger to exchange heat with the air introduced by the intake port;

a spacing part formed between the heat exchanger and an inner surface of the frame;

a fan disposed above the heat exchanger;

a discharge port disposed on at least one of a front surface of the frame and a top surface of the frame to discharge the air after exchanging heat with the heat exchanger;

a guiding surface extended from the inner surface of the frame to guide cool air passing through the heat exchanger; and a blocking surface extended from the guiding surface to be coupled to the inner surface of the frame, wherein the blocking surface comprises:

a first portion installed at the spacing part to block airflow from the rear opening toward the guiding surface and prevent condensate water from being formed on the guiding surface; and a second portion connecting the first portion and the guiding surface, wherein a portion of an outlet of the heat exchanger is located between the heat exchanger and the second portion, wherein a distance between the guiding surface and the blocking surface decreases downward, and wherein the guiding surface and the blocking surface are disposed above a center of the fan.

2. The indoor unit according to claim 1, further comprising a drain pan that collects condensate water generated by the heat exchanger, and the drain pan is higher than the intake port.

3. The indoor unit according to claim 2, wherein the heat exchanger has a portion that is positioned lower than any other portion of the heat exchanger, and the drain pan is disposed in a position corresponding to the lowest portion of the heat exchanger.

4. The indoor unit according to claim 3, wherein the heat exchanger is bent at least one time, and the bent portion of the heat exchanger is a lowest portion of the heat exchanger, wherein the drain pan is disposed in the position corresponding to the lowest portion of the heat exchanger.

5. The indoor unit according to claim 2, wherein the drain pan vertically overlaps with a center of the fan.

6. The indoor unit according to claim 1, wherein a center of the fan is closer to a front surface of the indoor unit than to the intake port.

7. The indoor unit according to claim 1, wherein a center of the fan is lower than a line bisecting a height of the indoor unit.

8. The indoor unit according to claim 1, further comprising:

an intake grill provided at the intake port, the intake grill is removably coupled to the frame; and a filter comprising a first filter for filtering air introduced through intake holes of the intake grill and a second filter supported by the intake grill for filtering air introduced through the rear opening of the frame, wherein, the second filter is inclined from the first filter, and when the intake grill is pulled down from the frame, the intake grill is removed from the frame and the filter is taken out from the frame.

9. The indoor unit according to claim 8, wherein the intake port is an opening at a bottom surface of the frame through which the filter passes through, and the intake grill covers the opening.

10. The indoor unit according to claim 9, wherein the filter is coupled to an upper portion of the intake grill.

11. The indoor unit according to claim 8, wherein the filter is integrally formed with the intake grill.

12. The indoor unit according to claim 8, wherein the frame is provided with a filter guide that guides the second filter to a certain position in the rear opening.

13. The indoor unit according to claim 8, further comprising:

a filter guide to guide moving of the filter, the filter guide comprising:

a first guide disposed at a first side of the second filter; and a second guide disposed at a second side of the second filter, the second side being opposed to the first side with respect to the second filter.

14. The indoor unit according to claim 13, wherein the first and second guides are provided in plurality.

15. The indoor unit according to claim 14, wherein the plurality of first guides are spaced apart from each other and the plurality of second guides are spaced apart from each other.

16. The indoor unit according to claim 1, wherein when a cross section of the indoor unit is divided into first to fourth quadrants by an X-axis and a Y-axis about a center of the fan, the first quadrant is a front upper portion of the indoor unit, the second quadrant is a rear upper portion of the indoor unit, the third quadrant is a rear lower portion of the indoor unit, and the fourth quadrant is a front lower portion of the indoor unit, wherein the intake port is disposed at the third quadrant, and the discharge port is disposed at least at one of the first quadrant and the second quadrant.

17. The indoor unit according to claim 16, wherein at least one portion of the heat exchanger is disposed at least at one of the third quadrant and the fourth quadrant.

* * * * *